United States Patent [19]

Coddington

[11] 4,054,116

[45] Oct. 18, 1977

[54] EMERGENCY FUEL LINE CLOSURE

[75] Inventor: Thomas Tucker Coddington, Troy, Mich.

[73] Assignee: Chrysler Corporation, Highland Park, Mich.

[21] Appl. No.: 675,438

[22] Filed: Apr. 9, 1976

[51] Int. Cl.[2] ..... F02B 77/08

[52] U.S. Cl. ..... 123/198 DB; 123/139 AZ; 417/295; 417/458; 417/507

[58] Field of Search ..... 123/198 D, 198 DB, 136, 123/139 A, 139 AZ; 417/295, 507, 458; 137/495

[56] References Cited

U.S. PATENT DOCUMENTS

| | | | |
|---|---|---|---|
| 2,212,486 | 8/1940 | Loder | 123/136 |
| 2,737,167 | 3/1956 | Dickey | 123/139 R |
| 3,148,671 | 9/1964 | Bottorff et al. | 123/136 X |
| 3,601,107 | 8/1971 | Rohrbacher | 123/136 |
| 3,923,425 | 12/1975 | Porter et al. | 417/507 X |
| 3,937,198 | 2/1976 | Sudhu | 123/136 |
| 3,969,041 | 7/1976 | Thausing et al. | 417/507 X |
| 3,994,358 | 11/1976 | Smitley | 417/295 R X |

*Primary Examiner*—C. J. Husar
*Assistant Examiner*—Ira S. Lazarus
*Attorney, Agent, or Firm*—Baldwin & Newtson

[57] ABSTRACT

An automobile engine driven fuel pump operates to cause alternate fuel pumping and fuel vacuum cycles in a fuel pumping chamber and concurrent alternate air vacuum and air pumping cycles respectively in an air pumping chamber and also to maintain a normally closed fuel control valve open in the fuel supply conduit to the pump during the fuel vacuum and air pumping cycles completely independently of the fuel pumping cycles. If the engine stalls, as for example in the event of a collision or automobile roll-over, the pump will stop and the control valve will close to prevent fuel leakage from the supply conduit. Pressure in the supply conduit also urges the control valve to its closed position.

22 Claims, 1 Drawing Figure

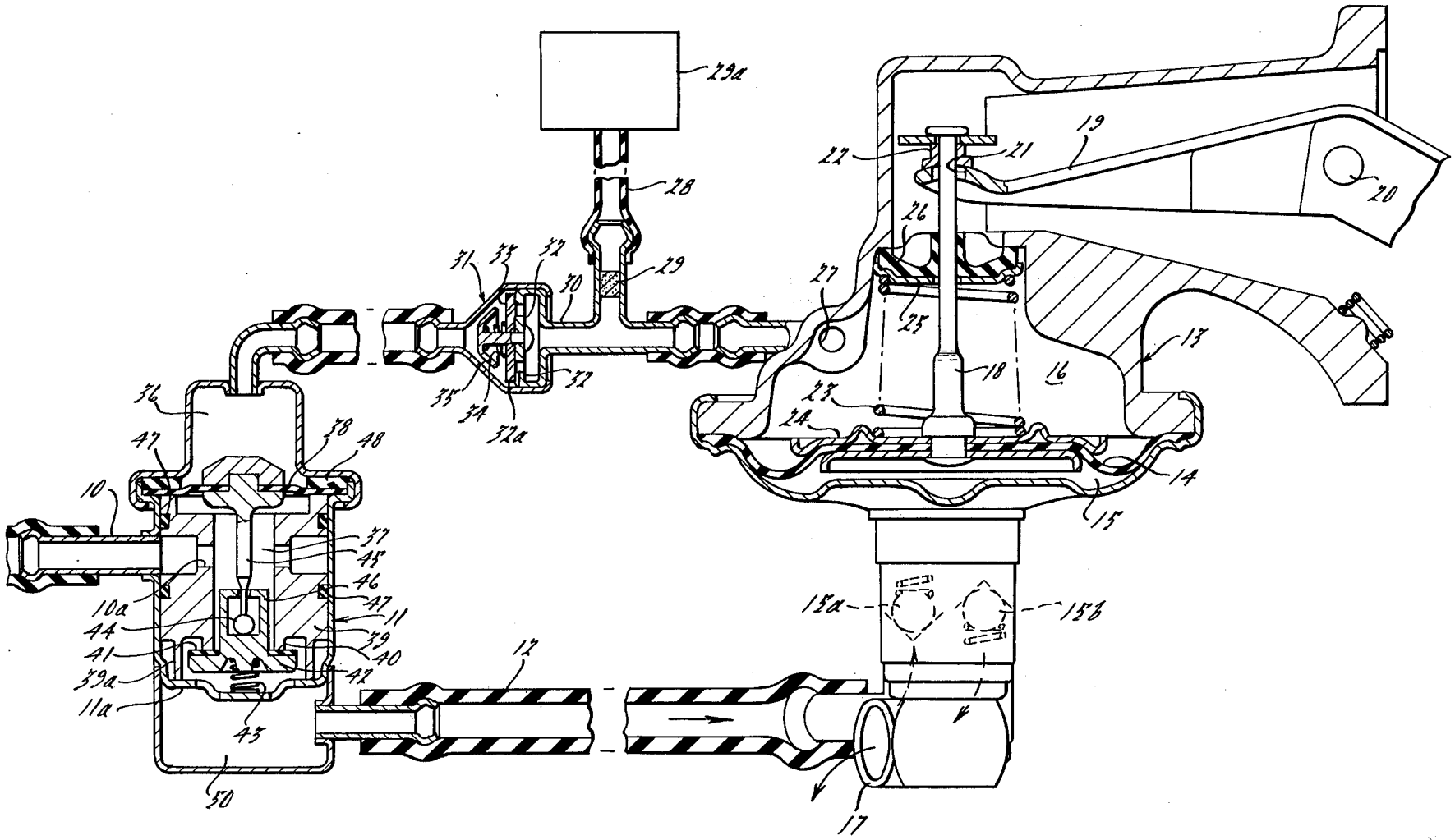

EMERGENCY FUEL LINE CLOSURE

BACKGROUND AND OBJECTS OF THE INVENTION

This invention relates to a fuel flow control valve in the fuel supply line between the fuel tank and an automobile engine driven fuel pump and has for a specific object the provision of improved fuel flow control means in the fuel supply line to prevent fuel leakage from the tank via the fuel line in the event of an accident, as for example where the automobile is rolled over or suddenly tilted to such an angle that fuel would otherwise flow by gravity through the fuel line from the tank.

Invariably in consequence of such an accident, the engine stalls. Another object therefore is to provide such a flow control valve which is normally closed to prevent fuel leakage from the fuel tank when the engine is not operating, but which opens automatically by operation of the fuel pump to enable starting of the engine by cranking, without requiring a resetting of the control valve or other structure, and remains open when the engine is operating.

Preferably the pump comprises a fuel pumping chamber operative to effect alternate fuel pumping and fuel vacuum cycles, and an air pumping chamber operative to effect concurrent air vacuum and air pumping cycles respectively. The chambers are connected with the control valve to maintain the latter open in response to either or both the air pumping and fuel vacuum cycles. The fuel pumping cycle has no effect in opening the control valve, which is thus practically immune to vapor lock conditions in the pump.

Other objects are to provide a flow control valve of the above character which is urged to its closed position by a fuel pressure head in the fuel supply line greater than atmospheric, and to provide means cooperable with the fuel pump and valve to accumulate small quantities of air pumped during the air pumping strokes to maintain the valve open uninterruptedly during cyclic operation of the pump, but which enables rapid closing of the valve when the pump stops.

Other objects of this invention will appear in the following description and appended claims, reference being had to the accompanying drawings forming a part of this specification wherein like reference characters designate corresponding parts in the several views.

The drawing is a schematic sectional view through the fuel pump and control valve in the fuel supply conduit.

It is to be understood that the invention is not limited in its application to the details of construction and arrangement of parts illustrated in the accompanying drawing, since the invention is capable of other embodiments and of being practiced or carried out in various ways. Also it is to be understood that the phraseology or terminology employed herein is for the purpose of description and not or limitation.

BRIEF DESCRIPTION OF THE PREFERRED EMBODIMENT

Referring to the drawing, a portion of the fuel supply conduit 10 from an automobile gasoline tank is illustrated in communication with a fuel control valve 11 operable as described below for controlling fuel flow through a fuel inlet conduit 12 to a fuel pump 13. The pump 13 is partitioned by a flexible diaphragm 14 into a fuel pumping chamber 15 and an air pumping chamber 16, the chamber 15 being in communication with the inlet 12 to receive fuel therefrom via a conventional one-way check valve **15*a*, which permits fuel flow into the chamber 15 only during a upward fuel vacuum stroke of diaphragm 14, and is in communication with a pump discharge line 17 to the carburetor via a second one-way check valve 15*b*, which enables fluid flow from the chamber 15 only during a downward fuel pumping stroke of a diaphragm 14**.

The diaphragm 14 is suitably connected to the lower end of an operating plunger 18 which is reciprocated by an oscillating lever 19 pivotal at 20 and operatively connected with the automobile engine for operation thereby. The swinging end of the lever 19 is provided with an opening 21 through which the upper end of the plunger 18 extends freely to complete a lost motion connection with the lever 19. A movement limiting stop 22 is secured to the upper end of the plunger 18 above the lever 19 so that upon clockwise pivoting, the stop 22, plunger 18, and diaphragm 14 are moved upwardly to effect an air pumping stroke in the air pumping chamber 16 and a fuel vaccum stroke in the chamber 15. Downward or counter-clockwise pivoting of lever 19 independently of the plunger 18 is permitted by means of the slot 21. Fuel that has been drawn into the chamber 15 during the upward fuel vacuum stroke of the diaphragm 14 will then be subject to the pressure of a fuel pumping spring 23 under compression between a support 24 for the diaphragm 14 and an upper spring retainer 25 backed by an annular portion of the housing for pump 13.

A suitable guide and seal 26 is contained between the latter annular portion and retainer 25 and around the plunger 18 in axially sliding and fluid sealing engagement therewith. An air vent 27, which customarily vents the air pumping chamber 16 to atmosphere, completes the structure of the fuel pump 13. The latter may be conventional and is accordingly not shown or described in further detail.

In the present instance, a first conduit branch 28 in communication with the vent port 27 is connected to atmosphere via a sintered orifice 29 which comprises both an air filter and a restriction to air flow to and from the atmosphere. The upper end of the branch conduit 28 above the restriction 29 may be connected to the atmosphere through a second filter 29a which may comprise the conventional inlet air filter for the carburetor. In parallel with the branch 28 is a second branch 30 communicating between the vent port 27 and a one-way check valve and air bleed combination 31 comprising a perforated plate 32 normally closed by a flapper valve 33, which allows air pumped from the chamber 16 through conduit 30 from right to left but which closes to prevent return movement of the air except by leakage through a shallow bleed groove 32a in the surface of the plate 32 confronting the valve 33. The valve 33 is normally held lightly against the left face of plate 32 by a light spring 34 under compression between the valve 33 and a suitable spring retainer 35 secured to the plate 32.

Down stream of the check valve 31, the branch conduit 30 opens into a small upper air accumulator or chamber 36 in valve 11 and partitioned from an intermediate fuel chamber 37 by a flexible diaphragm 38. The central opening of an annular insert 39 within the chamber 37 communicates with the supply conduit 10 via a radial port **10*a*. The lower end of the insert 39 provides an annular valve seat 40 against which a sealing ring 41** carried by an axially movable valve body 42 is normally maintained at a seated closed condition by a light spring 43 compressed between a perforated spring seat 11a and the underside of the valve body 42. The spring seat **11*a* comprises a portion of the housing for valve 11 and defines a lower perforated wall of chamber 37 which also supports a lower annular skirt 39*a* of the insert 39**.

The valve body 42 is actuated by a ball element 44 seated on an upper platform of the valve body 42 and secured to the lower end of a shaft 45 movable coaxially within the central opening of the insert 39. The upper end of shaft 45 is secured to the pressure actuated diaphragm 38. Extending upward around the ball element 44 in spaced relationship to effect a limited lost motion connection therewith are side portions 46 integral with the valve body 42.

By virtue of the structure described, the ball element 44 enables alignment of the body 42 and sealing ring or valve 41 at the seated position against seat 40 to close communication between chamber 37 and the portion of housing 11 downstream of valve body 42 when diaphragm 38 is not subject to more than atmospheric pressure in chamber 36, i.e. when pump 13 is not operating. Downward movement of the diaphragm 38 in response to a predetermined air pressure in chamber 36 when pump 13 is operating urges the ball element 44 against valve body 42 to force the latter and valve 41 to an open position against the yieldable spring 43. In the event of upward fuel pressure against the diaphragm 38, as for example when the pump 13 is not operating and a fuel pressure head exists in the supply conduit 10, the diaphragm 38 will move upwardly and after a limited lost motion upward movement of ball element 44 relative to the valve body 42, the ball element 44 will engage the overlying side portions 46 and in cooperation with the spring 43 close the valve 41 against the pressure of the aforesaid fuel head in conduit 10. In this regard, the effective area of diaphragm 38 exposed to fuel pressure within chamber 37 is greater than the corresponding effective area of the valve 41 and body 42, so that the resultant force of the fuel pressure head is effective to urge the valve body 42 upwardly to its closed position.

Suitable annular seals 47 between the insert 39 and the housing for control valve 11 prevent axial fuel leakage along the outer periphery of insert 39 from the conduit 10 and port **10*a* that might otherwise bypass the valve 41 at its closed position. Another annular seal 48 is provided between the housing for valve 11 at the air chamber portion 36 and the diaphragm 38 to clamp the latter firmly in fluid sealing engagement with an annular upper portion of the insert 39, thereby to prevent leakage between chambers 36 and 37**.

The inner wall of the annular skirt **39*a* extends around the outer periphery of the valve body 42 sufficiently closely to effect a slight resistance to fuel flow therebetween and cause the valve body 42 to operate in the nature of a poppet type valve when subject to low fuel pressure in the inlet conduit 12 as described below. The perforated plate 11a opens into a fuel chamber 50 provided by the lower protion of the housing for control valve 11 and communicates with the inlet conduit 12 for supplying fuel thereto in accordance with operation of the pump 13**.

In operation of the structure described, when the fuel pump 13 is not operating and a pressure exists in the fuel supply conduit 10, as for example in the event the automobile is rolled over in an accident or tilted steeply with the fuel tank above the mechanism shown, the fuel pressure alone acting within the chamber 37 against the underside of diaphragm 38 will move the valve body 42 to the closed position as described above in cooperation with the spring 43. Thus fuel leakage from the fuel tank and supply conduit 10 through the pump 13 is prevented.

During normal conditions when the engine is not operating, the fuel pressure within the fuel tank and in supply conduit 10 will be approximately atmospheric, as will be the air pressure in chamber 36 by virtue of the bleed **32*a* to atmosphere. When the automobile engine is cranked during a starting operation, the reciprocating pumping operation of the engine operated lever 19 will affect alternate air pumping and vacuum cycles within chamber 16 and concurrent fuel vacuum and pumping cycles within chamber 15. During each air pumping cycle or upward stroke of the diaphragm 14, the restriction 29 will cause pressurized air to be discharged through vent port 27 and the one-way check valve 31 to the air chamber 36. During the alternate fuel pumping or downward strokes of diaphragm 14, the pressure in chamber 36 will be maintained by virtue of the one-way check valve 31, except for slight leakage via the bleed 32*a*. Fresh filtered atmospheric air will enter the port 27 via the restricted branch conduit 28. Accordingly, the chamber 36 and check valve 31 operate as an air pressure accumulator to maintain a continuous valve actuating pressure in the chamber 36 during the cyclic operation of the pump 13. The restriction 29 is dimensioned to prevent the build-up of excess pressure in the conduit 30, chamber 36, and chamber 16, whereby effective operation of the fuel pumping stroke by spring 23** is also enabled.

The pressure in chamber 36 forces the diaphragm 38 and valve body 42 downwardly against the force of spring 43 to open valve 41, whereby fuel from source 10 is supplied via conduit 12 to the pump 13 and discharged to the carburetor via outlet 17 in accordance with the pumping cycles of diaphragm 14. In this regard, the operation of the pressure actuated diaphragm 38 in opening pressure actuated valve 42 is augmented by the concurrent fuel vacuum cycles of the pump 13. As the diaphragm 14 moves up in the concurrent air pumping and fuel vacuum cycles, the resulting subatmospheric pressure in chamber 15 will be transmitted via conduit 12 to chamber 50 below the valve 42 to urge the latter downwardly against the light upward force of spring 43.

The area of diaphragm 38 is preferably predetermined so that the air pressure in chamber 36 will be adequate to open the valve 41 even during ordinary cranking or starting of the engine. However, in the event the cranking or starting operation is extremely slow, as for example when an electric starting motor is employed in cold ambient conditions with a weak battery, the air pumped from chamber 16 through port 27 may be exhausted to atmosphere via restriction 29 too rapidly to operate diaphragm 38. In such an event, the fuel vacuum cycle will be adequate to open the valve 42 independently of plunger 45 by virtue of the lost motion connection 46 to enable starting of the engine. As soon as the valve body 42 opens slightly, its area exposed to the substantially atmospheric fuel pressure from the supply conduit 10 will be increased by reason of the annular restriction between the valve body 42 and annular skirt 39a, whereupon the valve body 42 and valve 41 will be moved downwardly to a wide open position and will be held open by less force per unit of area than required for the original opening, enabling the engine to start and to operate the pump 13 at higher speed.

Having described my invention, I claim:

1. In combination with an engine, a fuel system comprising, a fuel pump having a fuel pumping chamber and an air pumping chamber and driven by said engine to effect alternate fuel pumping and fuel vacuum cycles in said fuel pumping chamber and concurrent air vacuum and air pumping cycles respectively in said air pumping chamber, said fuel pumping chamber having fuel inlet means in communication with a fuel supply for said engine to receive fuel therefrom only during the fuel vacuum cycles and having fuel outlet means for discharging said fuel for use by said engine during the fuel pumping cycles, control valve means normally closing the communication between said fuel supply and inlet means, and control valve operating means independent of the fuel pressure in said fuel pumping chamber during said fuel pumping cycles and responsive to the pressure in at least one of said chambers during the alternate cycles for opening said control valve means to maintain the last named communication during operation of said pump.

2. In a fuel system according to claim 1, said control valve operating means comprising means responsive to the pressure in said air pumping chamber during said air pumping cycles for opening said valve means.

3. In a fuel system according to claim 2, said control valve operating means comprising means also responsive to the fuel pressure in said fuel pumping chamber during said fuel vacuum cycles for opening said valve means.

4. In a fuel system according to claim 1, said control valve operating means comprising means responsive to the fuel pressure in said fuel pumping chamber during said fuel vacuum cycles for opening said valve means.

5. In a fuel system according to claim 3, lost motion means connecting said means responsive to the pressure in said air pumping chamber with said valve means to enable opening of the latter independently of the last named pressure responsive means during said fuel vacuum cycles.

6. In a fuel system according to claim 1, said pump comprising resilient means yieldingly biasing operation of said pump for concurrently effecting said fuel pumping cycles and said air vacuum cycles, means operated by said engine for concurrently effecting said air pumping cycles and fuel vacuum cycles in opposition to said resilient means, said air pumping chamber having a restricted opening to the atmosphere, said control valve operating means comprising air pressure actuated means in communication with said air pumping chamber and responsive to pumping cycle pressures therein above a predetermined value for opening said valve means.

7. In a fuel system according to claim 6, said control valve operating means also including pressure actuated means in communication with said fuel pumping chamber and responsive to fuel vacuum cycle pressure therein below a predetermined value for opening said valve means.

8. In a fuel system according to claim 7, lost motion means connecting said air pressure actuated means and valve means for enabling opening of the latter in response to fuel vacuum cycle pressures and independently of operation of said air pressure actuated means.

9. In a fuel system according to claim 1, said air pumping chamber having a restricted opening to the atmosphere, said control valve operating means comprising air pressure actuated means in communication with said air pumping chamber and responsive to pumping cycle pressures therein above a predetermined value for opening said valve means.

10. In a fuel system according to claim 9, said control valve operating means also including pressure actuated means in communication with said fuel pumping chamber and responsive to fuel vacuum cycle pressures therein below a predetermined value for opening said valve means, lost motion means connecting said air pressure actuated means and valve means for enabling opening of the latter in response to fuel vacuum cycle pressures and independently of operation of said air pressure actuated means.

11. In a fuel system according to claim 1, said air pumping chamber having a restricted opening to the atmosphere, said control valve operating means comprising air pressure actuated means in communication with said air pumping chamber and responsive to pumping cycle pressures therein above a predetermined value for opening said valve means, means for integrating air pumping cycle pressures at said air pressure actuated means comprising flow control means for enabling comparatively unrestricted air flow from said air pumping chamber to said air pressure actuated means and for restricting air flow from the latter.

12. In a fuel system according to claim 11, said pump comprising resilient means yieldingly biasing operation of said pump for concurrently effecting said fuel pumping cycles and said air vacuum cycles, means operated by said engine for concurrently effecting said air pumping cycles and fuel vacuum cycles in opposition to said resilient means.

13. In a fuel system according to claim 1, said control valve operating means comprising pressure actuated means in communication with said air pumping chamber and responsive to pumping cycle pressures therein above a predetermined value for opening said valve means, and means for integrating air pumping cycle pressures at said air pressure actuated means comprising flow control means for enabling comparatively unrestricted air flow from said air pumping chamber to said air pressure actuated means and for restricting air flow from the latter.

14. In a fuel system according to claim 1, said control valve operating means comprising air pressure actuated means having one side in communication with said fuel supply and its opposite side in communication with said air pumping chamber when the pressure therein is greater than said fuel supply pressure, and means operatively connecting said pressure actuated means and valve means for urging opening of the latter in response to air pumping cycle pressure.

15. In a fuel system according to claim 14, said control valve operating means also comprising fuel pressure actuated means having opposite sides in communication respectively with said fuel supply and fuel inlet means to said fuel pumping chamber and operatively connected with said valve means for urging opening of the latter in response to fuel vacuum cycle pressures.

16. In a fuel system according to claim 15, means normally urging said valve means to its closed position in response to the fuel pressure of said fuel supply means comprising the effective area of said fuel pressure actuated means exposed to pressure of said fuel supply being less than the corresponding area of said air pressure actuated means, said fuel pressure actuated means being operatively connected with said valve means for urging the latter to its open position in response to said fuel supply pressure, said air pressure actuated means being operatively connected with said valve means for urging the latter to its closed position in response to said fuel supply pressure.

17. In a fuel system according to claim 16, the operative connection between said air pressure actuated means and valve means comprising limited lost motion means for enabling opening of the latter independently of limited opposing operation of said air pressure actuated means.

18. In a fuel system according to claim 1, said control valve operating means including means responsive to the fuel pressure of said fuel supply for urging closing of said control valve means.

19. In a fuel system according to claim 1, said control valve operating means comprising air pressure actuated means responsive to air pumping cycle pressures in said air pumping chamber for urging opening of said valve means, means for integrating the air pumping cycle pressures for operating said air pressure actuated means comprising flow control means for enabling comparatively unrestricted air flow from said air pumping chamber to said air pressure actuated means and for enabling restricted air flow from the latter.

20. In a fuel system according to claim 19, said control valve operating means including means responsive to the fuel pressure of said fuel supply for urging closing of said control valve means.

21. In a fuel system according to claim 19, said means for integrating including an air accumulating chamber in communication with said flow control means for receiving said comparatively unrestricted air flow, a fuel chamber in communication with said fuel supply and having a fuel port in communication with said inlet means to said fuel pumping chamber, said control valve means normally closing said fuel port, said air pressure actuated means comprising a yieldable wall partitioning said air accumulating chamber and fuel chamber, and means operatively connecting said movable wall and control valve means for urging opening or closing of said port in response to increasing pressure in said air accumulating chamber or fuel chamber respectively.

22. In a fuel system according to claim 21, said control valve operating means comprising means responsive to the pressure in said fuel pumping chamber during said fuel vacuum cycles for urging opening of said port, said means connecting said wall and valve means comprising a limited lost motion connection for enabling opening of said port independently of said wall during said fuel vacuum cycles.

* * * * *